United States Patent [19]

Maestri

[11] 4,432,484

[45] Feb. 21, 1984

[54] TOOL FOR DRIVING METAL FASTENERS IN A FRAME AND SETTING ITS REAR CLOSING PANEL

[75] Inventor: Elio Maestri, Milan, Italy

[73] Assignee: Romeo Maestri & Figli S.p.A., Milan, Italy

[21] Appl. No.: 218,423

[22] Filed: Dec. 19, 1980

[30] Foreign Application Priority Data

Dec. 24, 1979 [IT] Italy ..... 23473 79[U]
Dec. 24, 1979 [IT] Italy ..... 23474 79[U]

[51] Int. Cl.[3] ..... B25C 1/02; B25C 5/00
[52] U.S. Cl. ..... 227/126; 227/132
[58] Field of Search ..... 277/126, 132, 146, 120

[56] References Cited

U.S. PATENT DOCUMENTS

| | | | |
|---|---|---|---|
| 104,915 | 6/1870 | Woodworth et al. | 227/146 |
| 3,107,584 | 10/1963 | Powers | 227/126 X |
| 3,131,397 | 5/1964 | Miller | 227/146 |
| 3,708,095 | 1/1973 | Briggs, Jr. | 227/126 |
| 3,905,535 | 9/1975 | Novak et al. | 227/120 |
| 4,133,468 | 1/1979 | Ewig | 227/126 |
| 4,189,082 | 2/1980 | Solomon | 227/146 X |
| 4,342,414 | 8/1982 | Grzeika et al. | 227/120 X |

FOREIGN PATENT DOCUMENTS

| | | | |
|---|---|---|---|
| 1376987 | 9/1964 | France | 227/132 |

*Primary Examiner*—Paul A. Bell

[57] ABSTRACT

An improved tool for driving metal fasteners, such as nails, brads, tacks, staples and the like in a frame and setting its rear closing panel. The tool comprises a driving lever suitable to urge, against a loading spring, a driving hammer which slides in the hollow bed of the tool. When the driving lever and the driving hammer disengage each other, the compression spring urges the driving hammer towards the outlet opening of the metal fastener, the latter being fed from a feeding magazine essentially perpendicular to the direction towards which the hammer is moved said magazine being provided with a pusher member for the metal fasteners.

1 Claim, 20 Drawing Figures

TOOL FOR DRIVING METAL FASTENERS IN A FRAME AND SETTING ITS REAR CLOSING PANEL

BACKGROUND OF THE INVENTION

This invention relates to a tool for driving metal fasteners, such as nails, brads, tacks, staples, and the like in a frame and setting its rear closing panel.

It is well-known that for most frames the glass and the decorative motif or subject to be displayed are applied to the front moulding of the frame by means of a closing panel which is fixed at the back of the frame.

The fixing is usually made by driving the metal fastener in the internal side of the frame in a substantially parallel direction to the frame's plane, so that the projecting parts of the driven fastener make up a suitable means to prevent the detaching of the panel from the frame.

The metal fasteners have always been applied manually and this has obviously taken long working times and has involved high costs to get a finished frame.

In order to overcome these inconveniences the common stapling-machines have been used namely those mechanically worked machines for driving staples in which, by preloading means, a driver causes the staples to be ejected, that is those fixing components consisting of a thin U-shaped section.

The use of these machines turned out to be extremely difficult since they must be used in a position which is completely different from that one for which they are made. In fact, they are suitable for driving the staple according to a direction which is perpendicular to the plane on which they are put, while, in the specific case of the frame, the driving must be effected according to a direction which is parallel to the plane on which the machine is placed. The working of its driving means turns out to be extremely difficult when placing the tool in such a way that the driving of staples is made according to this last direction.

Further inconveniences of these machines consist in the fact that they do not allow a proper driving of the staple which, for fixing the panel, must be inserted into the frame so that its bridging part exerts a pressure on the panel. This is not possible with the above mentioned machines since the staple becomes disconnected from the support plane and consequently it does not adhere to the panel to be fixed.

Machines which are suitable for driving the fixing members of the panel in the frame have also been created; said members consist of substantially rhomboidal plates which are inserted by their top into the frame, their remaining portion being the fixing member of the panel.

But these machines still pose some problems concerning both the application of the fixing members and the safety of the fixing itself.

A first problem is due to the fact that the rhomboidal fixing member being inserted by its top in the frame may easily get out from it owing to its shape deflecting outward the frame section.

A further problem lies in the fact that the rhomboidal fixing plate must be thin both for having a less penetrating section in the frame and not to cause its breakage and in order to demand from the driver of the driving machine as little force as possible. In this situation, the rhomboidal fixing member is easily capable of being deformed, it is subject to distortions or breakages and, for large-sized frames, it does not ensure the necessary fixing capability.

Another drawback of these machines is due to the fact that the end of the driver joined together with the rhomboidal plate in order to cause it to be ejected and driven must be forcedly shaped in a complementary way for guiding the plate along a special ejection passage of the machine. It is clear that undesired shiftings to the rhomboidal plate in respect of the optimum position where it receives the end of the driver may occur and this can cause, owing to the displacements of the plate, the machine to be jammed.

Moreover, the driver of the machine will suit only for rhomboidal plates of particular size, beyond which it will be no more suitable.

SUMMARY OF THE INVENTION

It is the main object of this invention to provide a tool for driving metal fasteners in a frame and setting its rear closing panel adapted to overcome all above disadvantages.

BRIEF DESCRIPTION OF THE DRAWINGS

The particular features of the present invention together with the main advantages deriving from the same will become self-explanatory from the following detailed description of two non-limiting preferred embodiments thereof which are given with reference to the attached drawings in which the figures from 1 to 10 concern the tool for driving metal fasteners, such as brads, while figures from 11 to 20 concern the tool for driving staples.

In particular.

DESCRIPTION OF THE PREFERRED EMBODIMENTS OF THE INVENTION

Referring now to FIGS. 1 to 4, the tool, according to this invention, is comprised of a substantially rectangular-shaped casing 1 having a substantially central opening 2 which is fit to enable the entrance of the operator's hand to act on a driving lever which is indicated as a whole at 3.

Figure 1:
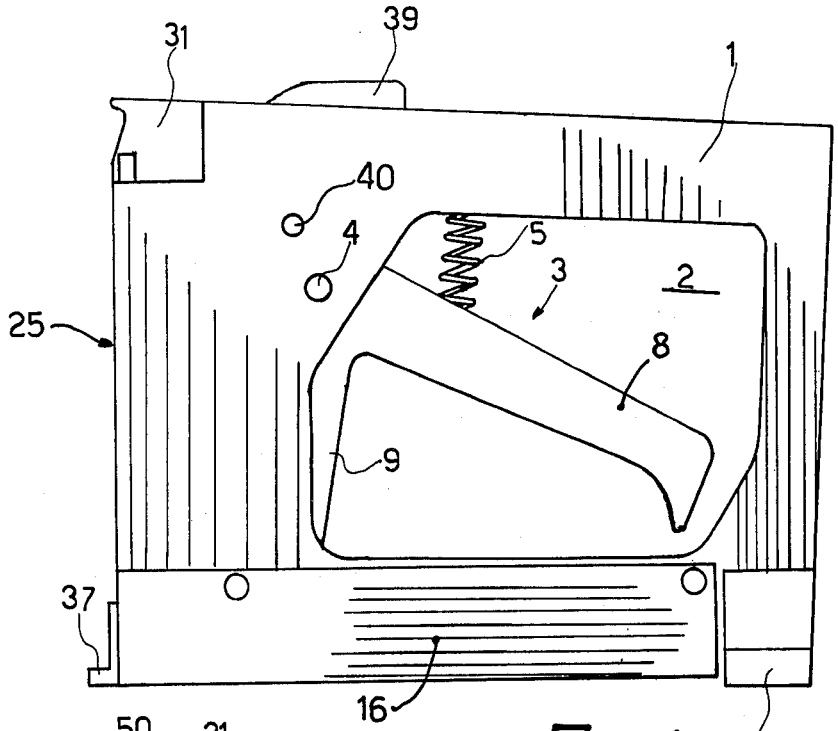
FIG. 1 is an overall side elevational view of the tool according to this invention for driving brads in its off-position.
Figure 2:
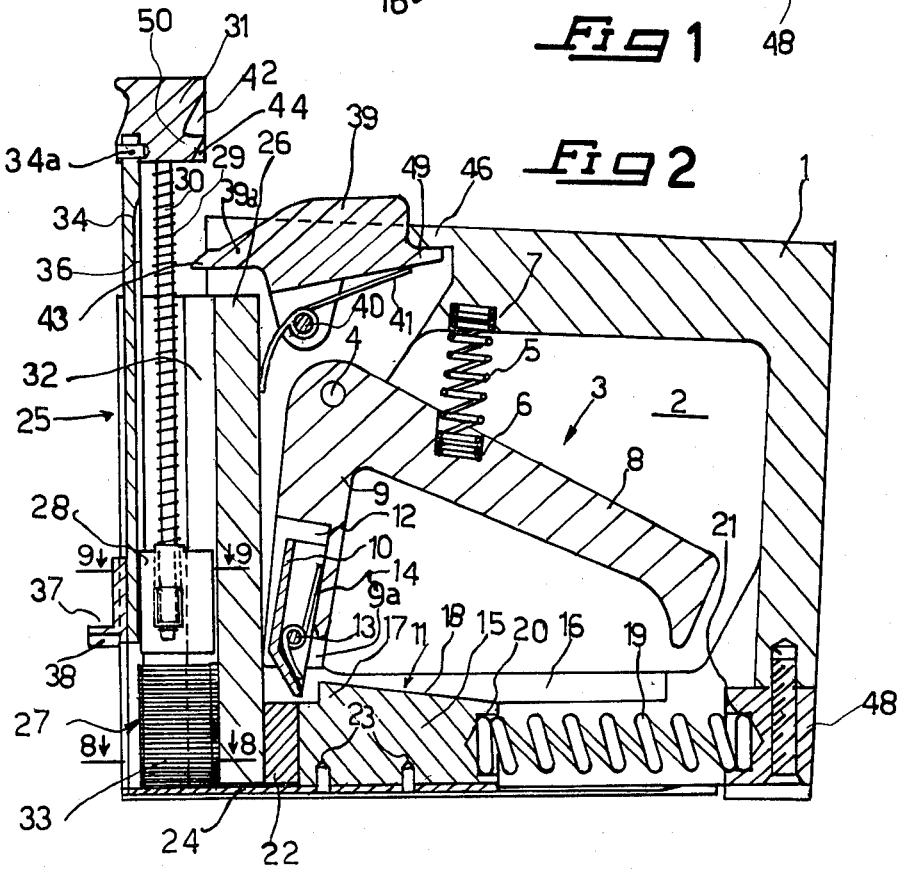
FIG. 2 is a view showing the tool in side elevational section showing the device for pushing the brads which is partially pulled out.

The driving lever 3 is set, on one side of the casing, on a pivot 4 of this latter and is kept in the position which is shown in FIGS. 1 and 2, that is in the off-position, by a spring 5 whose ends are inserted in a recess 6 of the lever 3 and in a recess 7 of the casing 1.

An arm 8 of the substantially L-shaped driving lever 3 protrudes within the opening 2 of the casing 1 for enabling the action by the operator.

The other arm 9 of the driving lever 3 is provided, on its end, with a pivoted member 10 in unidirectional rotation which will allow the urging of a driving hammer which is indicated as a whole at 11 in such a way that each fastener is successively ejected from the magazine and is driven in the frame.

Member 10 of the arm 9 consists of a body having in its lengthwise section a substantially trapezoidal shape which is located inside a recess 12 of the arm 9 and which is set on a pivot 13 of the latter.

A spiral spring 14 having an end engaged with the bottom of the recess 12 and the other one engaged with the inclined side of the member 10 keeps this latter in the position shown in FIG. 2. It will allow, on the contrary, the counter-clockwise rotations of the member 10, which are made possible by a recess 9*a* of the arm 9, for the reasons which will be set out in the description of how the machine works.

The hammer 11 consists of a substantially parallelepipedal block 15 sliding within the hollow bed 16 of the tool. On its front end that is that one which is turned toward the arm 9, the block 15 is provided with a catch 17 which is fit to be connected with the end of the protruding member 10 of the arm 9. The catch 17 slopes, toward its opposite end, forming an inclined plane 18.

The driving hammer 11 is operated on one side by the lever 3 in contrast with a loading spring 19 which is positioned in the hollow bed 16 of the tool and is connected with one end in a recess 20 of the back part of the block 15 and with the other one in a recess 21 of the bed 16.

In the off-position, namely that one which is shown in FIG. 2, the block 15 is kept, for the action of the spring 19, against a rubber pad 22 which is suitable for absorbing the pushes of the block 15 when operating the machine.

On the lower part of the block 15 is attached, for instance by means of rivets 23, an ejector member 24 which is fit to cause the metal fasteners to be ejected from the tool and to be driven in the frame.

Figure 7:
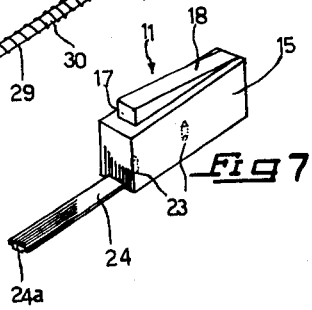
FIG. 7 is a perspective view showing the driver for the fasteners.

As it is shown more evidently in FIG. 7, the ejector member 24 consists of a metal bar 24*a* having, in its cross-section, a substantially T-shape.

The tool according to this invention includes also a magazine for feeding the fasteners which is indicated as a whole at 25. The magazine 25 is essentially perpendicular to the direction towards which the hammer 11 is moved and it consists of a housing unit 26 for a plurality or "strip" 27 of metal fasteners within which there is a sliding pusher member 28 which serves for pushing the strip of fasteners 27 towards the ejection passage, operated by a spring 29 which is positioned on a rod 30. The rod 30 is attached, on one end, to the head 31 of the feeding device of fasteners while on the other end the pusher member 28 is sliding.

Figure 8:
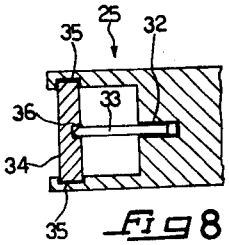
FIG. 8 is a view according to the section 8—8 of FIG. 2 of the feeding magazine for the fasteners.
Figure 9:
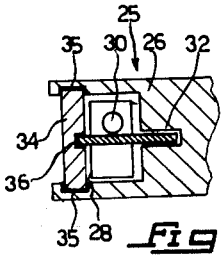
FIG. 9 is a view according to the section 9—9 of FIG. 2 of the feeding magazine for the fasteners.

The housing unit 26 presents, as it is shown in particular in FIGS. 8 and 9, a central longitudinal slot 32 within which the head of the fasteners 33 is inserted and the pusher member 28 slides.

The feeding magazine 25 of the fasteners 33 is provided on its front part, that is on the outside of the tool, with a sliding closing wall 34 integral with the rod 30 since its upper end is attached, by means of a screw 34*a*, to the head 31. The wall 34 slides within longitudinal grooves 35 which are provided in the side walls of the magazine 25.

Figure 4:
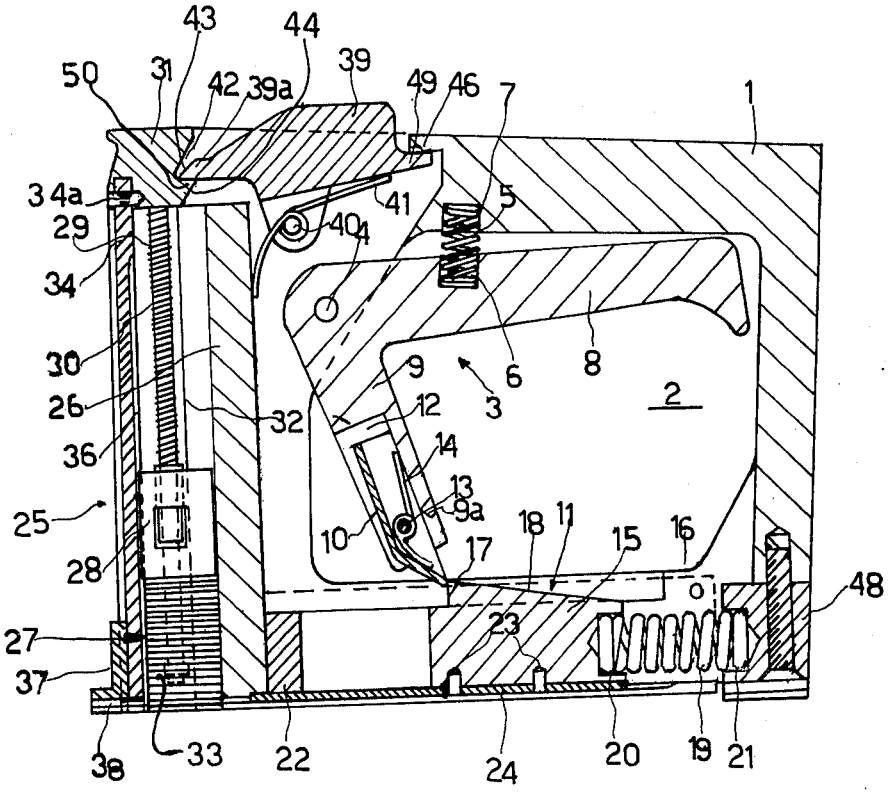
FIG. 4 is a side elevational view of the tool showing it in the phase which is immediately ahead of the ejection of a fastener.
Figure 3:
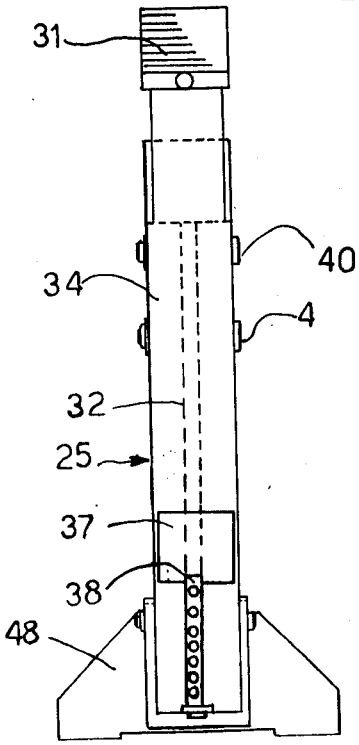
FIG. 3 is a front elevational view of the tool in the same position of FIG. 2.
Figure 6:
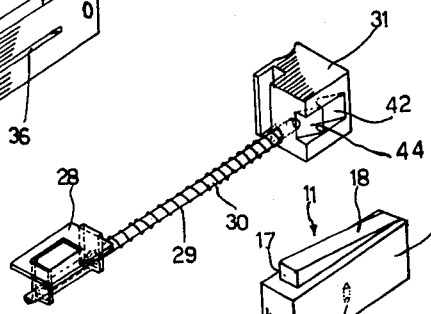
FIG. 6 is a perspective view showing the pusher member for the fasteners inside the magazine.

As can be seen from FIGS. 4, 6 and 9, the pusher member 28 slides centrally within the housing unit 26 and is staggered as to the rod 30 in order to allow its sliding on the latter.

The rod 30 extends as far as the lower end of the housing unit 26 sideward the strip of fasteners 27 while the pusher member 28 must be able to slide within said housing unit as the fasteners are ejected from the tool.

A catch will grip the pusher member 28 at the end of its run on the rod 30.

The closing wall 34 have inside a longitudinal slot 36 which is opposite to the slot 32 for completing the guide of the strip of tacks 27.

Figure 5:
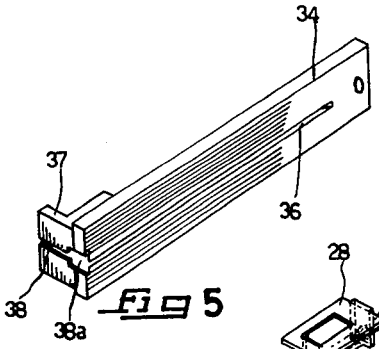
FIG. 5 is a perspective view showing a part of the magazine housing the fasteners and particularly the external portion of it.

The closing wall 34 of the magazine 25 has on its lower end a slide-member for the fasteners 33 which is indicated at 37. This slide-member 37 consists of a substantially L-shape body, with one side parallel to the direction towards which the fasteners 33 are ejected from the tool. This side, which is that one parallel to the lower rim of the tool, is provided with a passage 38 through which the tacks 33 will be ejected, operated by the ejection rod 24. This latter will push the fasteners 33 downwardly and cooperating with part 24*a* (FIG. 7) eject the same through the passage 38 while its end will be catched within the initial portion 38*a* FIG. 5 of the passage 38 which has a section larger than the passage 38.

The tool according to this invention includes finally a locking device of the pusher of the fasteners inside the magazine 25. This device comprises a locking lever 39 FIG. 2 which is located in the upper part of the tool and is swinging around a pivot 40 of the casing 1. The end 39*a* of the lever 39 is urged against a tooth 50 of the head 31 of the pusher 28 by a coil-spring 41. When fthe pusher member must be brought from the outward position which is shown in FIG. 2 to the operating position which is shown in FIG. 4, it will be enough to cause the clockwise rotation of the lever 39 by acting on its upper end and to introduce the pusher member inside the magazine 25 till the shaped end 39*a* of the lever 39 is engaged in the corresponding recess 42 of the head 31 which is defined by the tooth 50. To this purpose, in order to make easier this operation, the end 39*a* of the lever 39 and the lower rim of the head have a raking part which is indicated at 43 and 44 respectively.

From FIG. 2 it can be seen that in the outward position of the pusher member 28 further rotations are prevented by the other end 49 which is engaged with a pawl 46 of the casing 1.

Figure 10:
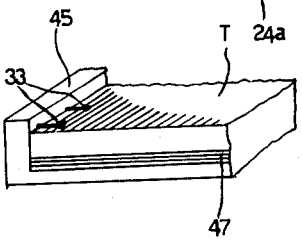
FIG. 10 is a schematic perspective view showing a part of a finished frame with the fasteners driven in it.
Figure 11:
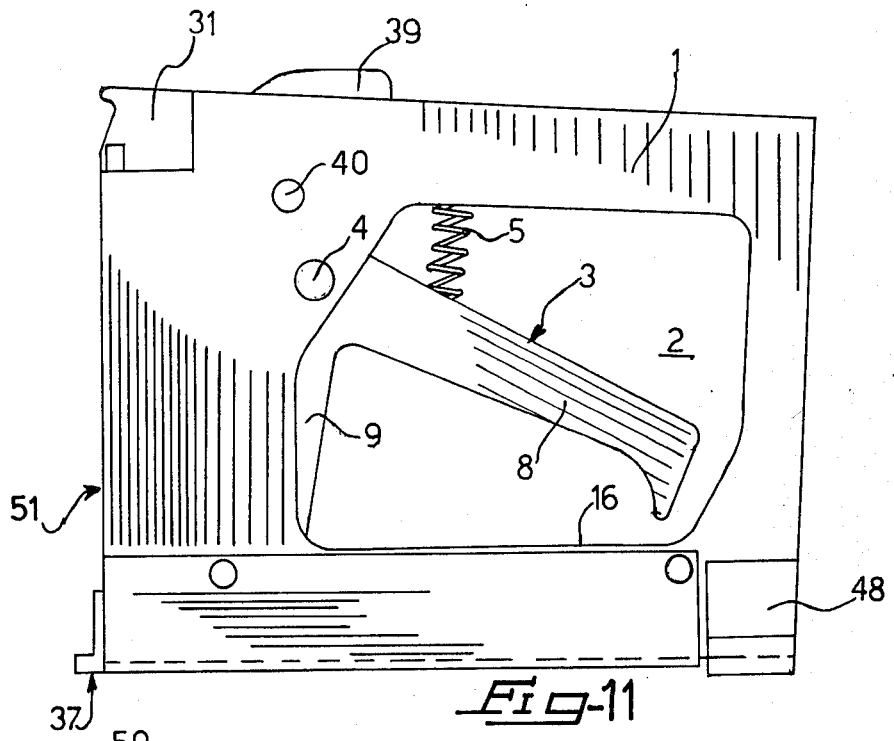
FIG. 11 is an overall side elevational view of the tool according to this invention for driving staples in its off-position.
Figure 12:
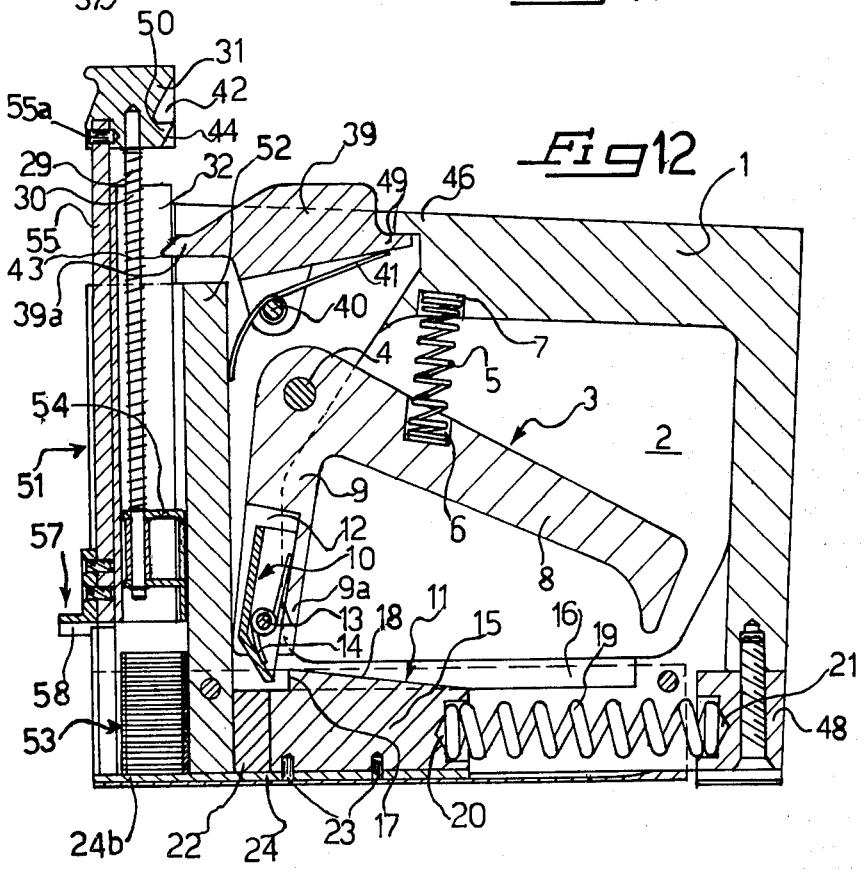
FIG. 12 is a side elevational view showing the tool in section showing the pusher member for the staples which is partially pulled out.
Figure 14:
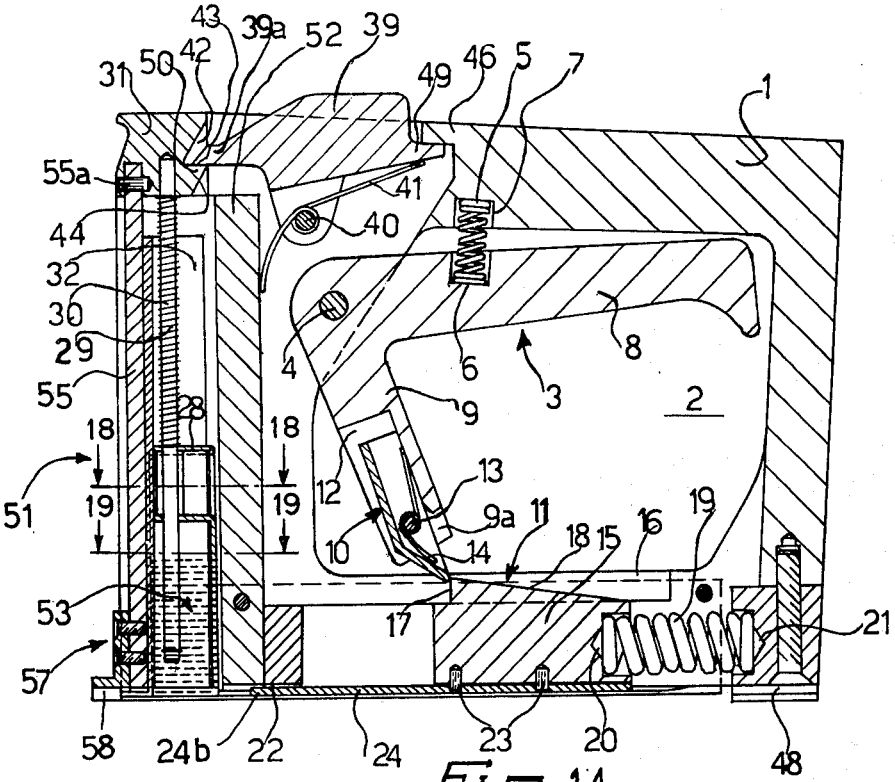
FIG. 14 is a side elevational view of the tool in its lengthwise section showing it in the phase which is immediately ahead of the ejection of a staple.
Figure 13:
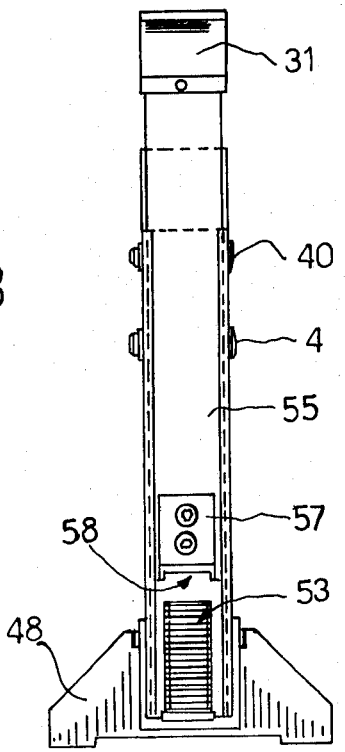
FIG. 13 is a front elevational view of the tool in the same position as in FIG. 12.
Figure 15:
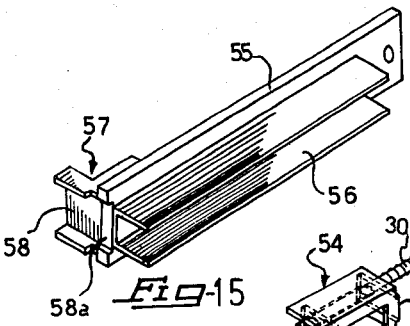
FIG. 15 is a perspective view showing part of the magazine housing the staples and particularly the external portion of it.

Referring now to FIG. 10, it is shown how the metal tacks 33 are driven in the frame 45 for setting its panel T to it in order to keep in place the decorative motif or subject to be displayed and the glass which are indicated as a whole at 47 in FIG. 10.

The working of the tool according to this invention for driving and setting fasteners as per the above briefly described way is as follows.

Beginning from the off-position which is shown in FIG. 1 and also in FIG. 2, presuming that the pusher device is inserted into the magazine 25, the operator causes the driving lever 3 to rotate counter-clockwise so much that it assumes the position shown in FIG. 4. The hammer 11 will be consequently moved rearwardly by pushing the driving spring 19.

The end of the member 10 of the arm 9 of driving lever 3 will slide along the front surface of catch 17 on hammer 11 so much it reaches its top.

The operator still imparting the counter-clockwise rotation to the lever 3 will cause the member 10 to get over this position for disengaging it from the hammer 11 which will be urged towards the outlet part of the fasteners by spring 19, where the fasteners will be ejected after having been pushed through the ejection passage 38 by the driving member 24.

Upon release of pressure by the operator on driving lever 3, the lever 3 will be drawn back in the off-position by the spring 5 and its member 10 will be drawn back in the position shown in FIG. 2 by means of the spring 14 which will allow its counterclockwise rotation, while its end will slide on the inclined plane 18 so much that it can reach its original position opposite the catch 17.

The rear part of the tool is provided with a stand foot 48 which is suitable for keeping the back end of the tool slightly raised in comparison with the terminal part where the fasteners are ejected, so that this latter is as near as possible to the panel T and the tool remains perpendicular to the stand plane.

Referring now to FIGS. 11 to 19 the tool is hereby described according to the invention in another embodiment for setting staples.

Most of the components parts or pieces making up this version of the tool and their placing are essentially the same; consequently they will be indicated with the same reference numbers and will not be described in detail. This applies particularly to the elements which are marked from 1 to 24.

Figure 17:
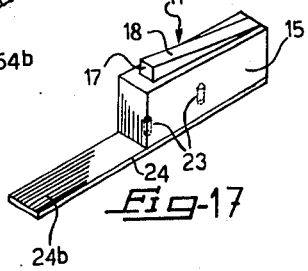
FIG. 17 is a perspective view showing the driver for the staples.

According to this embodiment, as it appears particularly from FIG. 17, the staples ejector member 24 consists of a bar 24*b* having a rectangular cross-section.

The feeding magazine of the staples, which is indicated as a whole at 51, consists of a housing space 52 for a plurality of "strip" 53 of staples within which a pusher member 54 is slidable and which is suitable for pushing the strip of staples 53 towards the ejection passage, operated by a spring 29 which is wound round a rod 30.

The rod 30 has one end attached to a head 31 of the device feeding the staples while the other end is provided with the pusher member 54 sliding on the rod 30.

The magazine 51 has on its front part, that is on the outside of the tool, a sliding closing wall 55 integral for sliding with the rod 30 since its upper end is attached, by means of a screw 55*a*, to the head 31. The wall 55 slides within longitudinal grooves 35*a* which are disposed in the side walls of the magazine 51 as it can be seen in particular in FIGS. 18 and 19.

On the internal side of the wall 55 a U-shaped member 56 is provided which is substantially as high as the magazine 51 and is adapted to guide the staples 53 in their lengthwise movement within the housing 52.

Figure 16:
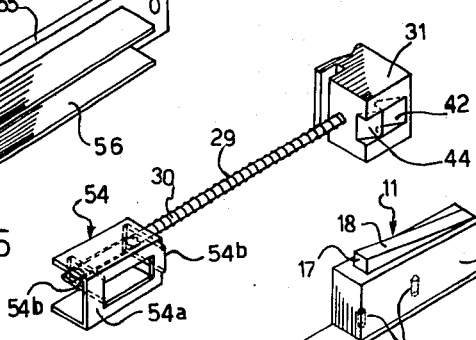
FIG. 16 is a perspective view showing the pusher member of the staples which is inside the magazine.

As it appears more particularly to FIG. 16 where the pusher member 54 is shown in detail, this latter consists of a substantially U-shaped body 54*a* which is provided with two tabs 54*b* sliding along the rod 30 which will be provided on its end, like the previous case, with a proper catch in order to grip the pusher member 54.

Figure 18:
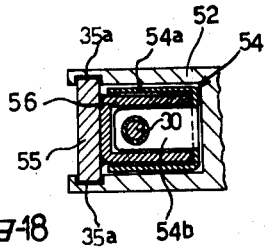

From FIG. 18 it can be seen that the rod 30 is located in a central position both as regards to the U-shaped member 56 and to the pusher 54. Moreover, the U-shaped member 56 and the pusher are symmetrically opposed between them.

Figure 19:
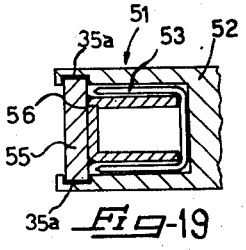
FIGS. 18 and 19 are views showing the feeding magazine for the staples, said figures corresponding to the sections 18—18 and 19—19 respectively of FIG. 14.

The FIG. 19 shows that the U-shaped member 56 holds the "strip" of staples 53 against the internal walls of the housing 52 of the magazine 51 and this occurs up to the terminal part where the staples are ejected and the member 56 terminates.

The closing wall 55 of the magazine 51 is provided on its lower end with a slide member of the staples 53 which is indicated at 57. The slide member 57 consists of a substantially L-shaped body having one side which is parallel to the direction towards which the staples 53 are ejected from the tool. This side which is parallel to the lower rim of the tool is provided with a passage 58 through which the staples 53 will be ejected, operated by the ejection rod 24*b*. This latter will push the staples 53 with its end through a passage 58*a* of the wall 55 and the passage 58 of the member 57 as to cause their driving.

The tool according to this invention includes finally a locking device of the pusher of the staples inside the magazine 51. This device is equivalent to that of the first preferred embodiment of the tool according to this invention. Its component parts are indicated by the same reference numbers and consequently it will not be further described.

Figure 20:
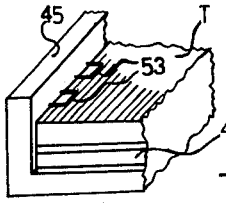
FIG. 20 is a schematic perspective view showing a part of a finished frame with the staples driven in it.

Referring now to FIG. 20 there is shown how the staples 53 are driven in the frame 45 for setting its panel T to it in order to keep in place the decorative motif or subject to be displayed and the glass which are indicated as a whole at 47 in FIG. 20.

The working of the tool according to this invention for driving and setting the staples as above described is essentially the same as that of the first preferred embodiment and, consequently, it will not be specified further.

In this version as well a stand foot 48 is provided in the rear part of the tool having the same above mentioned characteristics and purposes.

It is obvious that it will be possible to make variants and/or changes to the tool according to this invention without departing from the protective scope of the same.

What I claim is:

1. A tool for driving metal fasteners into a frame, comprising:

a casing, an L-shaped handle having a handle portion and a driving lever portion, said handle being pivotably mounted on and within said casing, said handle being movable between an actuating position and a non-actuating position, resilient means connected to said casing and said handle, said resilient means being movable to a biased position upon manual movement of said handle from said non-actuating position to said actuating position and further movable to an unbiased position upon release of said handle from said actuating position wherein said handle is biased from said actuating position to said non-actuating position, said lever portion of said handle forming a recess at the end of said handle, a catch member mounted in said recess, said catch member being rotatably movable about a pivot in said recess, said catch mechanism having a normal position in said recess, biasing means positioned in said recess and engaged with said driving lever and said catch biasing member, said biasing means being for biasing said catch member in said normal position and for allowing movement of said catch member in one direction away from said normal position to a rotated position wherein said biasing means is additionally biased, said recess including a space for receipt of a portion of said catch member in said rotated position, slidable hammer means positioned in the bottom of said casing, said hammer means being movable between an unbiased position and a baised ejecting position, said hammer means being for receiving said catch member for movement from said unbiased position to said biased ejecting position upon manual movement of said handle toward said actuating position, said catch member being for moving said hammer means from said unbiased position to said biased ejecting position and for releasing said hammer means from said biased ejecting position upon further movement of said handle to said actuating position thereupon releasing said hammer means for biased movement to said unbiased position, spring means positioned between said casing and said hammer means, said spring means being for moving said hammer from said biased ejecting position to said unbiased position, a removable loading magazine in said casing containing fasteners in stacked relationship substantially perpendicular to the slidable movement of said hammer means, said loading magazine forming a fastener ejection passage, means cooperating with said hammer means for ejecting said fasteners from said ejection passage upon movement of said hammer means from said biased ejecting position to said unbiased position;

means for pushing said fasteners downwardly within said magazine toward and to said ejection passage, a locking lever means pivotably mounted on the upper portion of said casing between the top of said means for pushing and said casing, said locking lever means having a locked mode and an unlocked mode, wherein in said locked mode said locking lever means biasedly urges the top of said means for pushing downwards in said magazine, and wherein in said unlocked mode said top of said means for pushing is released from said locking lever means, and coil spring means connected to said upper portion of said casing for biasedly urging said locking lever means downwardly over said magazine and for biasedly allowing rotatable movement of said locking lever means upwards away from said magazine and downwards away from said casing.

* * * * *